US006527253B2

(12) United States Patent
Struck

(10) Patent No.: US 6,527,253 B2
(45) Date of Patent: Mar. 4, 2003

(54) LIFTING DEVICE

(75) Inventor: Detlef Struck, Wuppertal (DE)

(73) Assignee: Yale Industrial Products GmbH, Velbert (DE)

( * ) Notice: Subject to any disclaimer, the term of this patent is extended or adjusted under 35 U.S.C. 154(b) by 0 days.

(21) Appl. No.: 09/928,871

(22) Filed: Aug. 13, 2001

(65) Prior Publication Data

US 2002/0027222 A1 Mar. 7, 2002

Related U.S. Application Data

(63) Continuation of application No. PCT/DE00/04325, filed on Dec. 2, 2000.

(30) Foreign Application Priority Data

Dec. 13, 1999 (DE) ..... 199 59 999

(51) Int. Cl.[7] ..... B66D 1/14
(52) U.S. Cl. ..... 254/346; 254/371
(58) Field of Search ..... 254/371, 366, 254/368, 346

(56) References Cited

U.S. PATENT DOCUMENTS

| | | | | | |
|---|---|---|---|---|---|
| 1,572,001 | A | * | 2/1926 | Dotzert | 254/372 |
| 1,876,954 | A | * | 9/1932 | Johnson | 254/372 |
| 1,993,744 | A | * | 3/1935 | Morison | 254/372 |
| 2,403,462 | A | * | 7/1946 | Schroeder | 254/372 |
| 2,417,492 | A | * | 3/1947 | Hinchcliffe | 254/372 |
| 2,548,846 | A | * | 4/1951 | Robins et al. | 254/372 |
| 3,894,720 | A | * | 7/1975 | Koji | 254/372 |
| 5,566,925 | A | * | 10/1996 | Wada et al. | 254/372 |
| 5,586,752 | A | * | 12/1996 | Wada et al. | 254/372 |
| 6,007,054 | A | * | 12/1999 | Kobayashi et al. | 254/372 |
| 6,032,928 | A | * | 3/2000 | Okamoto et al. | 254/372 |
| 6,062,543 | A | * | 5/2000 | Kobayasi et al. | 254/372 |

FOREIGN PATENT DOCUMENTS

| | | |
|---|---|---|
| DE | 35 07 724 A | 9/1986 |
| EP | 0 643 008 A | 3/1995 |
| FR | 1 193 419 A | 11/1959 |

* cited by examiner

*Primary Examiner*—Emmanuel Marcelo
(74) *Attorney, Agent, or Firm*—Henry M. Feiereisen

(57) ABSTRACT

The invention relates to a lifting device with a housing having a drive wheel, a friction disk brake, a load wheel and a gear arranged sequentially in an axial direction inside the housing. The drive shaft extends through the friction disk brake and the load wheel. A torque is transmitted from the drive wheel to the load wheel. The drive wheel cannot move axially on the drive shaft, but can rotate over a limited range relative to the drive shaft. The drive wheel can rotate in a limited fashion relative to a brake disk, which is axially moveable on a threaded section of the drive shaft and can be pressed with the help of a friction disk against a pressure disk that is attached to the housing. The drive wheel forms a component of the friction disk brake.

5 Claims, 4 Drawing Sheets

LIFTING DEVICE

CROSS-REFERENCE TO RELATED APPLICATIONS

This application is a continuation of PCT Application No. PCT/DE00/04325, filed Dec. 2, 2000, which claims the priority of German patent application DE 199 59 999.8 filed Dec. 13, 1999.

FIELD OF THE INVENTION

The invention relates to a lifting device for raising, lowering and moving a load. The lifting device has a drive wheel, a friction disk brake, a load wheel and a gear, which are arranged sequentially in an axial direction inside a housing. The drive wheel can be coupled with the gear by way of a drive shaft which extends through the friction disk brake and the load wheel. The gear is located on the drive shaft on the opposite end from the drive wheel and transfers torque to the load wheel.

BACKGROUND OF THE INVENTION

Lifting devices of this type are used particularly for loads that are to be moved vertically. Such lifting devices include a drive wheel, which is frequently implemented as a chain wheel and can be rotate in both directions using a manually operated round link chain. However, instead of the chain wheel, a toothed wheel can also be used. Moreover, the drive wheel can be implemented as a coupling wheel for coupling to a motor shaft.

The load wheel which is typically implemented as a chain wheel, is coupled through a round link chain with a load receiving means, for example a crane hook.

The housing of the lifting device is typically provided with a hook for suspending the housing from suitable support bearings.

The drive wheel, a friction disk brake, the load wheel and a gear are arranged sequentially in an axial direction inside the housing, with the gear frequently having the form of a planetary gear. The drive wheel sits on one end of a drive shaft which extends through the friction disk brake and the load wheel. The gear is located on the other end of the drive shaft which is connected to the load wheel in order to transmit torque.

In a known design of a lifting device of the aforedescribed type (brochure from Yale industrial products GmbH, 5620 Velbert 1 "Yale Flaschenzug/Hoist/Palan à bras Mod. VS"), the friction disk brake is comprised of a ratchet disk, of friction disks disposed on both sides of the ratchet disk, as well as of two detents which are pivotally supported on the housing and urged by leg springs against the ratchet disk. The two friction disks are frictionally coupled, on one hand, with the ratchet disk and, on the other hand, with a pressure disk affixed to the shaft or the drive wheel, respectively. The drive wheel is axially moveable on a thread disposed on one end of the drive shaft. The other end of the drive shaft is coupled with two toothed wheels which are operatively connected with a toothed wheel by toothed pinions having a smaller diameter. The toothed wheel has inside teeth in which a pinion engages which in turn is coupled with the load wheel.

The friction disk brake is provided to hold the load carried by the lifting device at a respective height when the drive wheel is stopped. In this case, the drive wheel is pressed via the friction disks and the ratchet disk against the pressure disk. The detents rest in the peripheral recesses disposed on the ratchet disk.

When the drive wheel is rotated in the direction for raising the load, the detents slide across the teeth of the ratchet disk until the drive wheel stops. The detents then engage again with the recesses of the ratchet disk. When the load is lowered, the drive wheel rotates in the opposite direction, thereby axially sliding on the motion thread of the drive shaft, so that the frictional contact with the friction disks, the ratchet disk and the pressure disk is eliminated. The load can then descend until the coasting shaft once more compensates the axial play.

It would be desirable to improve the conventional design because the friction disk brake can fail when foreign particles enter the brake or the coil springs break. In addition, the noise originating from the detents are objectionable in many applications, in particular where this noise produces a noxious noise level. Moreover, the friction disk brake, in particular the ratchet disk, is expensive to manufacture.

It is therefore an object of the invention to provide a lifting device of a simpler design, which is less susceptive to malfunction and produces less noise.

SUMMARY OF THE INVENTION

According to one aspect of the invention, the drive wheel can rotate relative to the drive shaft within certain limits, but is prevented from moving on the drive shaft in an axial direction. In addition, the drive wheel is coupled to a brake disk for limited relative rotation thereto. The brake disk can move in the axial direction on a threaded section of the drive shaft. A friction disk is located between the brake disk, and a pressure disk is attached to the housing of the lifting device.

When the load is to be raised, the drive wheel is rotated clockwise. After a predetermined rotation angle over which the drive wheel can rotate freely relative to the drive shaft, the free rotation ends and the drive shaft is driven directly by the hand wheel, without loading the brake. Since the threaded sections have a right-handed thread, the brake disk is released from the friction disk for clockwise rotation, thereby canceling the braking action.

When the rotation of the drive wheel is stopped, the drive shaft which rotates under the influence of the load, pulls the brake disk against the friction disk and thereby against the pressure disk. The load is arrested.

For lowering the load, the drive wheel has to be turned counterclockwise. After a predetermined rotation angle, the drive wheel is coupled with the brake disk. The brake disk is axially displaced on the threaded section towards the drive wheel due to the right-handed thread section, so that brake disk does no longer contact the pressure disk via the friction disk. The load can then coast according to the predetermined rotation angle between the drive wheel and the brake disk. The load is braked in that the drive shaft, which rotates under the load, pulls the brake disk against the friction disk and the friction disk against the pressure disk. Advantageously, the design of the invention is significantly more accurate than conventional designs and operates more quietly. The lifting device according to the invention is also less complex due to the reduced number of components.

It should also be emphasized that the drive shaft and accordingly also the load wheel are driven directly by the drive wheel, without loading the friction disk brake.

The drive wheel can be driven using a chain, a rope, a crank or a motor, as is known in the art.

According to an advantageous embodiment, the drive wheel is rotatably supported on a bushing which is secured on the drive shaft The bushing can be pressed onto the drive shaft.

According to another advantageous embodiment, for transmitting torque, one end face of the drive wheel has a projection, which cooperates with a wing disk that is non-rotatably connected with the drive shaft. After the drive wheel has rotated by a predetermined rotation angle, the projection contacts a limit stop disposed on the drive wheel and locks both the wing disk and the drive shaft to prevent relative rotation therebetween.

The position of the bushing on the drive shaft is fixed by the wing disk that is pushed onto the drive shaft and prevented from rotating relative to the drive shaft.

The wing disk is preferably pushed onto a serration located on the end of the drive shaft and pressed against the bushing by a nut, with a radial collar of the bushing being pressed against a shoulder of the drive shaft. The drive wheel is thereby precisely guided between the radial collar and the end face of the wing disk facing the radial collar. The wing disk includes at least one radially projecting wing which cooperates with at least one projection provided on the end face of the drive wheel. The free rotation of the drive wheel on the drive shaft is limited by the cooperating projection and wing. The load can then be raised by the drive wheel. Preferably, the wing disk has two radial wings that are mutually offset by 180°. Two corresponding projections, which cooperate with the wings are then also provided on the end face of the drive wheel; in particular, the projections cast as one piece with the drive wheel.

According to yet another advantageous embodiment, the brake disk has a driven pin which is oriented in the axial direction and has a radial spacing to the drive shaft. The driven pin can move relative to and engage with a segmented recess of the drive wheel located on a side facing the load wheel. The driven pin catches the segmented, preferably arcuate, recess. The ends of the recess in which the driven pin engages, are formed by radially oriented ribs. The brake disk is entrained by the drive wheel in order to lift the brake disk from the pressure disk when the load is lowered, so that the friction disk brake is released.

According to still another advantageous embodiment, the brake disk is pressed against the pressure disk by a spring supported on the drive wheel. This spring is intended to produce an initial braking torque, thereby reducing the response time of the friction disk brake.

Further features and advantages of the present invention will be apparent from the following description of preferred embodiments and from the claims.

BRIEF DESCRIPTION OF THE DRAWINGS

The following figures depict certain illustrative embodiments of the invention in which like reference numerals refer to like elements. These depicted embodiments are to be understood as illustrative of the invention and not as limiting in any way.

DETAILED DESCRIPTION OF PREFERRED EMBODIMENTS

Figure 1:
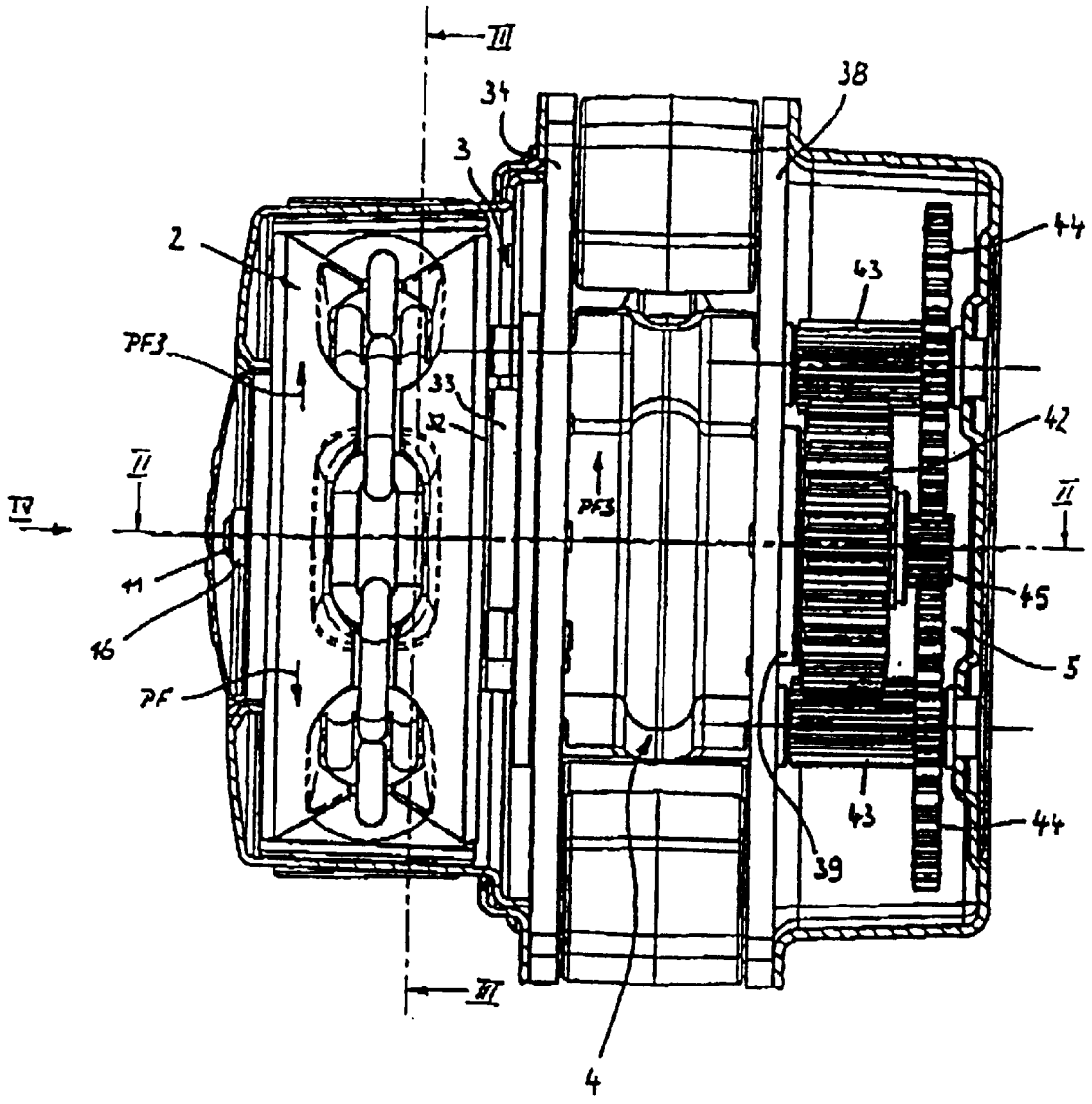
FIG. 1 is a top view of a lifting device.

FIGS. 1 to 4 illustrate a lifting device, designated with the reference numeral 1, which is used for raising and lowering loads L.

The lifting device 1 includes a drive wheel 2, a friction disk brake 3, a load wheel 4, and a gear 5, which are sequentially arranged in an axial direction inside a housing G which is not described in detail. The drive wheel 2 is disposed on one end 6 of a drive shaft 7, with the drive shaft 7 which extends through the friction disk brake 3 and the load wheel 4, capable of coupling the drive wheel 2 to the gear 5, which is located on the other end 8 of the drive shaft 7 and drives the load wheel 4 for transmitting a torque.

The end 6 of the drive shaft 7 that carries the drive wheel 2, which has the form of a chain wheel 4 supporting a round link chain (not shown), is provided with a cylindrical longitudinal section 9 (FIG. 2), which transitions at the end face into a serration 10 and from the serration 10 into a threaded section 11. A bushing 13 having a radial collar 12 is placed on the cylindrical longitudinal section 9 and pushed towards a shoulder 14 of the drive shaft 7. The bushing 13 is then pressed against the shoulder 14 by a wing disk 15, wherein a nut 16 is turned on the threaded section, with the nut capable of pressing the wing disk 15 against the bushing 13 and the bushing 13 against the shoulder 14 (FIGS. 1, 2 and 4).

Figure 4:
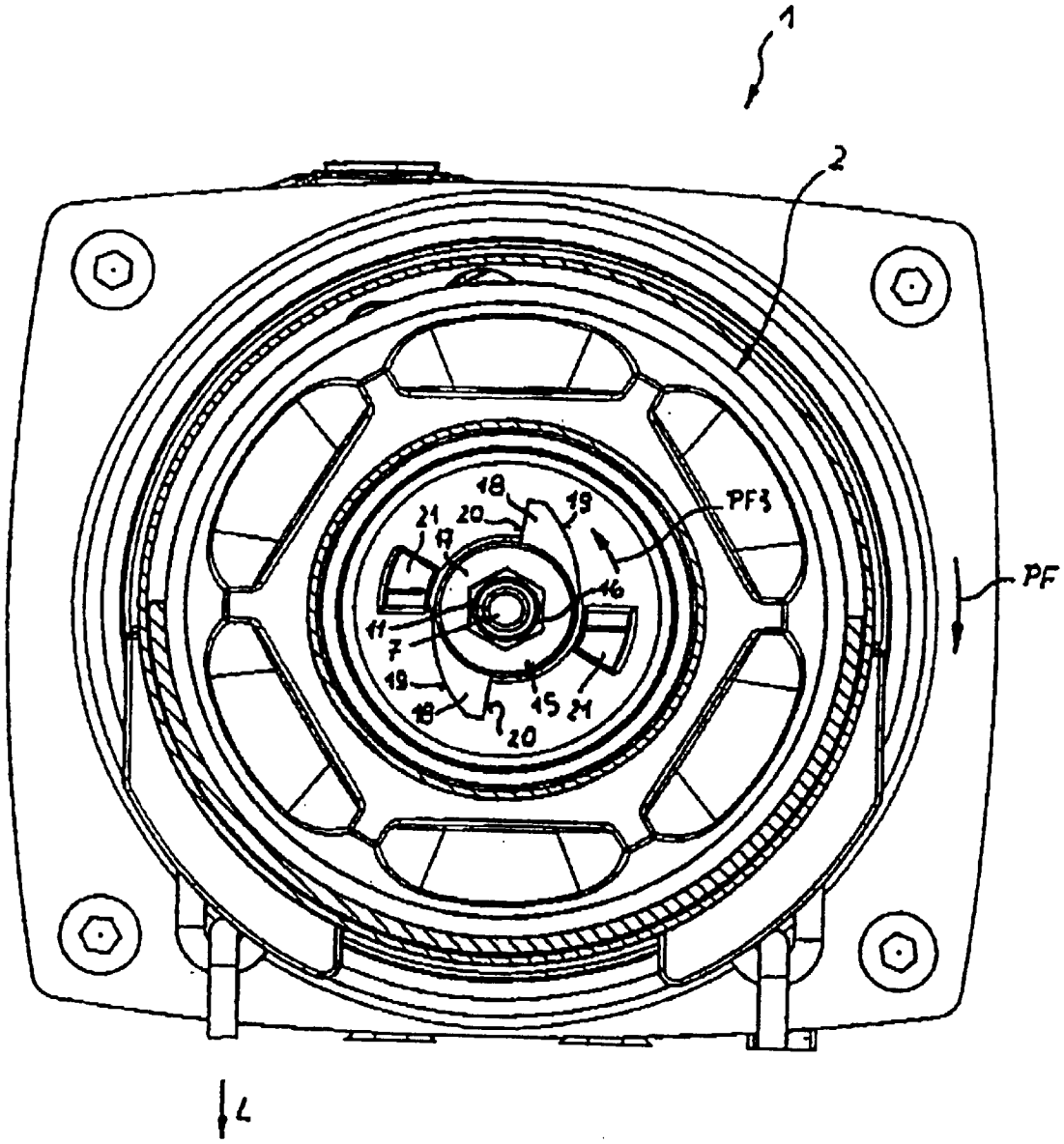
FIG. 4 is a front view in the direction of the arrow IV of FIG. 1 without a cover.

The wing disk 15 is seen clearly in FIG. 4. The wing disk 15 has a central ring-shaped body 17 with two radially projecting wings 18 which are mutually offset by 180° and connected to the ring-shaped body 17. Each of the wings 18 has an arcuate rear section 19 and a limit stop face 20 extending in a radial plane. The limit stop faces 20 of the wings 18 make contact with projections 21 which are formed as a single piece with the free side 22 of the drive wheel 2.

Figure 2:
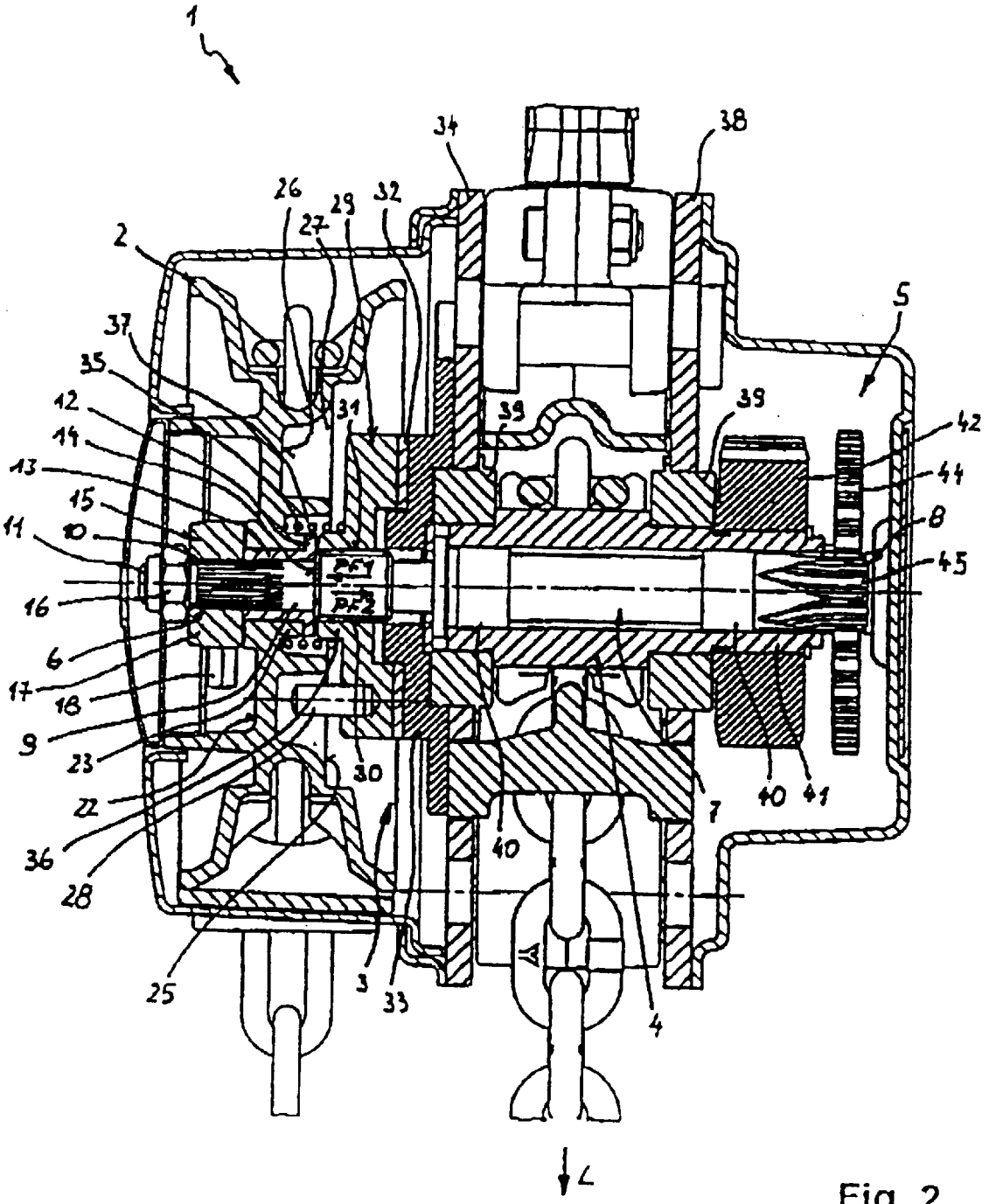
FIG. 2 is a vertical longitudinal section along the line II—II of FIG. 1.

The drive wheel 2 has an inner hub 23, which slidingly guides the drive wheel 2 between the radial collar 12 of the bushing 13 and the opposite end face 24 of the wing disk 15 (FIG. 2).

On the side 25 facing away from the projections 21, the drive wheel 2 has three arcuate segmented recesses 26 (FIGS. 2 and 3) which are delimited by three radial ribs 27. A driven pin 28, which is secured on a brake disk 29 with a radial distance to the drive shaft 7, engages with one of the recesses 26. The brake disk 29 has an inside thread 30, allowing it to move in the axial direction on an outside thread 31 of the drive shaft 7 located next to the cylindrical longitudinal section 9. The inside thread 30 and the outside thread 31 are formed as right hand-handed motion threads.

The brake disk 29 has a circular cross-section on the side facing away from the drive wheel 2 and contacts a friction disk 32, which is in turn pressed against a pressure disk 33. The pressure disk 33 is secured on a cross plate 34 which is part of the housing (FIG. 2). A coil pressure spring 35 that overlaps with an axial nipple 36 of the brake disk 29 and engages with a ring-shaped recess 37 of the drive wheel 2, assists in bringing the brake disk 29 in contact with the friction disk 32, and the friction disk in contact with the pressure disk 33.

The cross plate 34 of the housing G that supports the pressure disk 33 in conjunction with an additional parallel spaced-apart cross plate 38 provides a rotatable support for the load wheel 4 which forms a chain wheel for a round link chain (FIGS. 1 and 2). The bearings for the load wheel 4 in the cross plates 34 and 38 are designated by the reference numeral 39. The load wheel is supported for relative rotation on two axially spaced-apart cylindrical sliding planes 40 of the drive shaft 7. An axial nipple 41 of the load wheel 4 engages with a toothed wheel 42 which is non-rotatably disposed on this nipple 41 next to the cross plate 38.

As depicted in both FIGS. 1 and 2, the toothed wheel 42 meshes with two pinions 43 which are part of two toothed wheels 44, which in turn mesh with an end section 45 of a toothed wheel disposed on the drive shaft 7.

Figure 3:
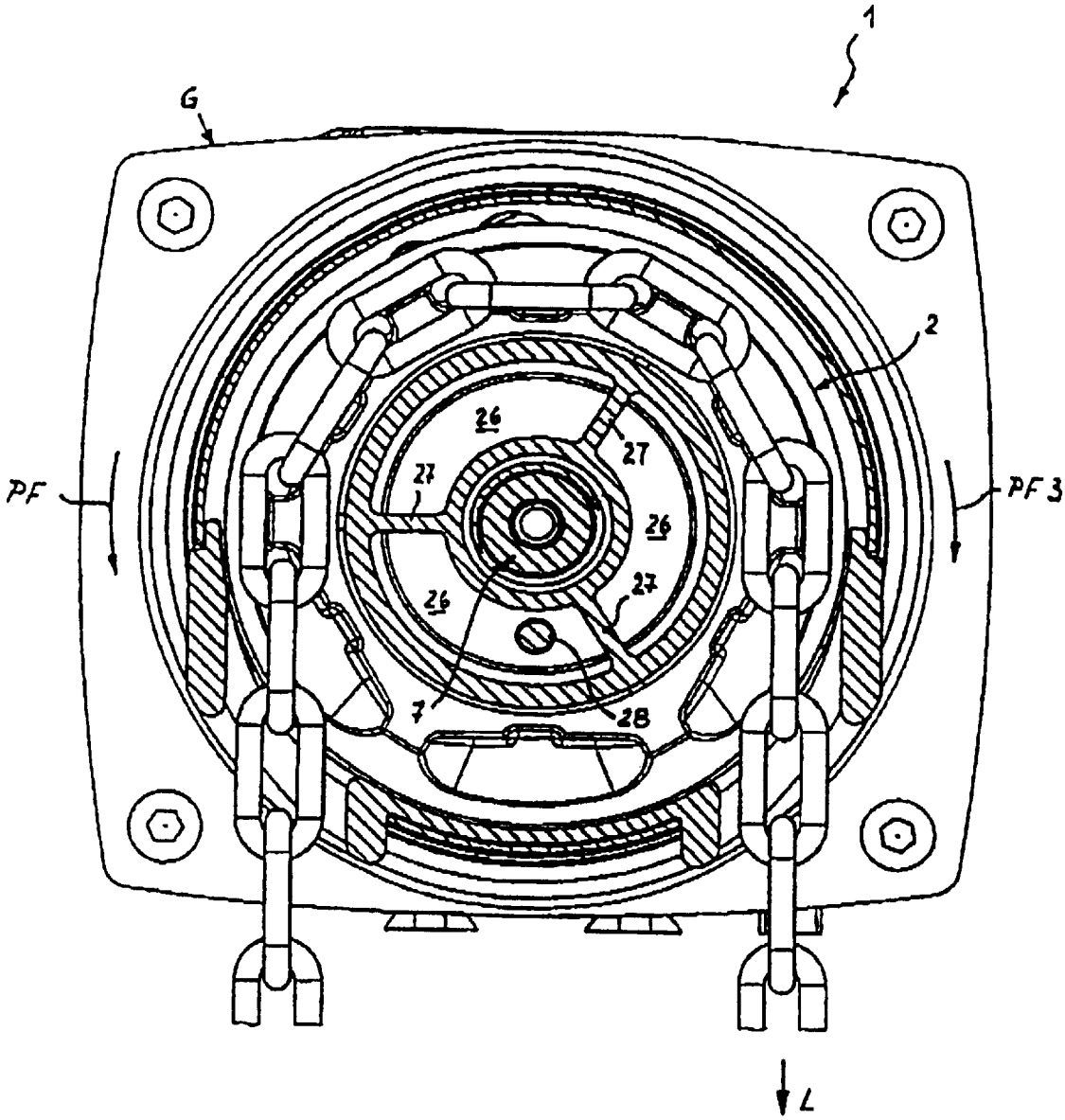
FIG. 3 is a vertical cross-section along the line III—III of FIG. 1.

Assuming that a load L is to be raised, the drive wheel 2 rotates clockwise in the direction of arrow PF, as indicated in FIGS. 1, 3 and 4. Since the drive wheel 2 can initially rotate freely on the bushing 13 relative to the drive shaft 7, the drive wheel 2 rotates relative to the drive shaft until the projections 21 make contact with the wings 18 of the wing disk 15. Because the wing disk 15 prevented from rotating on the drive shaft 7 by the serration 10, the drive shaft 7 then also rotates clockwise in the direction of arrow PF. Accordingly, a torque is directly transmitted from the drive wheel 2 to the load wheel 4 via the drive shaft 7 and the gear 5. Because the motion threads 30,31 of the brake disk 29 and the drive shaft 7 are right-handed threads, the brake disk 29 is lifted from the friction disk 32 in the direction of the arrow PF1 of FIG. 2, and the friction disk 32 is lifted from the pressure disk 33, when the drive wheel 2 is rotated clockwise in the direction of the arrow PF. The load can be raised without a breaking action.

When the drive wheel 2 is stopped, the suspended load L causes the load wheel 4 to rotate in the direction of arrow PF3, i.e., counterclockwise, and also causes rotation of the drive shaft 7. Accordingly, the brake disk 29 is pulled against the friction disk 32 in the direction of the arrow PF2, and the friction disk 32 is pulled against the pressure disk 33. The position of the load is fixed at that height (FIGS. 1–4).

When the load L is to be lowered, the drive wheel 2 rotates counterclockwise in the direction of the arrow PF3, as shown in FIGS. 1–4. After a predetermined rotation angle, the driving pin 28 makes contact with a rib 27 of the drive wheel 2. As a result, the brake disk 29 is also displaced on the motion threads 31 of the drive shaft 7 and is lifted from the friction disk 32, while the friction disk 32 is lifted from the pressure disk 33. The load L then causes the drive shaft 7 to rotate relative to the drive wheel 2, so that the brake disk 29 is pulled again in the direction of the arrow PF2 against the friction disk 32, and the friction disk 32 in turn is pulled against the pressure disk 33, braking the load L.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. Lifting device with a housing comprising a drive shaft arranged in the housing and defining an axial direction, and a drive wheel, a friction disk brake, a load wheel and a gear arranged sequentially in that order on the drive shaft, with a torque being transmitted from the drive wheel to the load wheel, wherein the drive wheel is prevented from moving axially on the drive shaft, but is enabled for limited rotation relative to the drive shaft, wherein the friction disk brake further comprises a brake disk, a friction disk, and a pressure disk attached to the housing, and wherein the drive wheel is enabled for limited rotation relative to the brake disk, which can move axially on a threaded section of the drive shaft and can be pressed against the pressure disk with the help of the friction disk.

2. The lifting device of claim 1, further comprising a bushing secured on the drive shaft, with the drive wheel being rotatably supported on the bushing.

3. The lifting device of claim 1, further comprising a wing disk which is non-rotatably connected with the drive shaft, wherein an end face of the drive wheel includes a projection which cooperates with the wing disk for transmitting a torque.

4. The lifting device of claim 1, wherein the drive wheel further comprises a segmented recess located on a side facing the load wheel, and wherein the brake disk has a driven pin oriented in the axial direction and adapted for relative movement to and engagement with the segmented recess of the drive wheel.

5. The lifting device of claim 1, wherein the brake disk is pressed against the pressure disk by a spring supported on the drive wheel.

* * * * *